US008020608B2

(12) United States Patent
Delano et al.

(10) Patent No.: US 8,020,608 B2
(45) Date of Patent: Sep. 20, 2011

(54) HEAT SINK FIN WITH STATOR BLADE

(75) Inventors: Andrew Douglas Delano, Fort Collins, CO (US); Brandon Aaron Rubenstein, Loveland, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1758 days.

(21) Appl. No.: 10/931,099

(22) Filed: Aug. 31, 2004

(65) Prior Publication Data

US 2006/0042777 A1 Mar. 2, 2006

(51) Int. Cl.
*F28F 7/00* (2006.01)

(52) U.S. Cl. ..... 165/80.3; 165/80.2; 165/121; 361/697; D13/179

(58) Field of Classification Search ..... 165/80.1, 165/80.2, 80.3, 80.4, 121; 361/697; D13/179
See application file for complete search history.

(56) References Cited

U.S. PATENT DOCUMENTS

| | | | | |
|---|---|---|---|---|
| 2,434,676 | A * | 1/1948 | Spender | 165/80.3 |
| 2,772,861 | A | 12/1956 | Dailey | |
| 3,372,733 | A * | 3/1968 | Callender | 165/80.3 |
| 3,416,597 | A * | 12/1968 | Kupferberg | 165/80.3 |
| 5,077,601 | A | 12/1991 | Hatada et al. | |
| 5,132,780 | A | 7/1992 | Higgins, III | |
| 5,304,845 | A | 4/1994 | Lindquist et al. | |
| 5,597,034 | A | 1/1997 | Barker et al. | |
| 5,661,638 | A | 8/1997 | Mira | |
| 5,785,116 | A | 7/1998 | Wagner | |
| 6,157,539 | A | 12/2000 | Wagner et al. | |
| 6,196,300 | B1 | 3/2001 | Checchetti | |
| 6,404,634 | B1 | 6/2002 | Mann | |
| 6,543,522 | B1 * | 4/2003 | Hegde | 165/80.3 |
| 6,552,902 | B2 | 4/2003 | Cho et al. | |
| 6,631,756 | B1 * | 10/2003 | Hegde | 165/121 |
| 6,633,484 | B1 | 10/2003 | Lee et al. | |
| 6,657,862 | B2 * | 12/2003 | Crocker et al. | 165/80.3 |
| 6,659,168 | B1 | 12/2003 | Barsun | |
| 6,671,172 | B2 * | 12/2003 | Carter et al. | 165/80.3 |
| 6,681,842 | B2 | 1/2004 | Wagner | |
| 6,742,581 | B2 * | 6/2004 | Mochizuki et al. | 165/80.3 |
| 6,758,262 | B2 * | 7/2004 | Kawabata et al. | 165/80.3 |
| 6,927,979 | B2 | 8/2005 | Watanabe et al. | |
| 6,937,473 | B2 * | 8/2005 | Cheng et al. | 165/80.3 |
| 7,063,130 | B2 | 6/2006 | Huang | |
| 7,108,055 | B2 * | 9/2006 | Krassowski et al. | 165/80.3 |
| 7,164,582 | B2 * | 1/2007 | Hegde | 165/80.3 |
| D552,564 | S * | 10/2007 | Mochizuki | D13/179 |
| 7,286,352 | B2 * | 10/2007 | Curtis et al. | 361/697 |
| D568,829 | S * | 5/2008 | Yamashita et al. | D13/179 |
| 7,515,417 | B2 * | 4/2009 | Lee et al. | 165/80.4 |
| 7,950,446 | B2 * | 5/2011 | Zhang | 165/80.3 |

(Continued)

OTHER PUBLICATIONS

U.S.PTO, U.S. Office Action dated Sep. 12, 2007 for U.S. Appl. No. 10/941,157, filed Sep. 15, 2004; pp. 1-9.

(Continued)

*Primary Examiner* — Ljiljana Ciric

(57) ABSTRACT

Systems, methodologies, and other embodiments are associated with a heat sink with a fin configured with a stator blade. One example includes a heat sink apparatus configured to experience a fan-assisted air flow. The example heat sink apparatus may be configured to include a fan that is configured to produce an air flow in the heat sink apparatus and a heat sink that houses the fan. The example heat sink may include a base and fins that are configured with stator blades.

25 Claims, 12 Drawing Sheets

U.S. PATENT DOCUMENTS

| | | | | |
|---|---|---|---|---|
| 2001/0050164 | A1 | 12/2001 | Wagner et al. | |
| 2002/0017378 | A1* | 2/2002 | Hu | 165/80.3 |
| 2003/0102110 | A1* | 6/2003 | Wagner | 165/80.3 |
| 2003/0131970 | A1 | 7/2003 | Carter et al. | |
| 2003/0221816 | A1* | 12/2003 | Ellsworth et al. | 165/80.3 |
| 2004/0045702 | A1 | 3/2004 | Barsun | |
| 2004/0134646 | A1* | 7/2004 | Chu et al. | 165/80.3 |
| 2005/0000682 | A1* | 1/2005 | Chien et al. | 165/80.3 |
| 2005/0211416 | A1* | 9/2005 | Kawabata et al. | 165/80.3 |
| 2005/0241800 | A1 | 11/2005 | Hegde | |
| 2011/0114296 | A1* | 5/2011 | Horng et al. | 165/121 |

OTHER PUBLICATIONS

U.S.PTO, U.S. Office Action dated Mar. 21, 2007 for U.S. Appl. No. 10/941,157, filed Sep. 15, 2004; pp. 1-9.

U.S.PTO, U.S. Office Action dated Oct. 11, 2006 for U.S. Appl. No. 10/941,157, filed Sep. 15, 2004; pp. 1-9.

U.S.PTO, U.S. Office Action dated May 2, 2006 for U.S. Appl. No. 10/941,157, filed Sep. 15, 2004; pp. 1-9.

* cited by examiner

HEAT SINK FIN WITH STATOR BLADE

BACKGROUND

Fins employed in heat sinks that are configured to experience a fan-assisted air flow have typically been manufactured together with and as part of an assembly that includes a base for the heat sink. For example, fins employed in a two pass radial fin heat sink have typically been machined from the same blank or poured into the same mold as the base. By way of illustration, a single extruded solid round bar of aluminum may be machined with a lathe, a circular slitting saw, and the like, to form the fins and the base as an integral unit. The fins and base for the heat sink device may be configured to house a fan that may be configured to produce a dual air flow. Producing such fins as part of a single piece base and fin assembly may produce certain limitations in these fins.

An example conventional heat sink cooling device configured to experience a fan-assisted dual air flow is described in U.S. Pat. No. 5,785,116, issued Jul. 28, 1998. In one example, the '116 patent describes a heat sink having a housing formed from cooling vanes and a base machined from a single piece of material. The cooling vanes are arranged so that air passes over them twice. The vanes are illustrated as being substantially uniform and substantially featureless. The vanes and base are manufactured into an integral two pass, radial fin heat sink.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
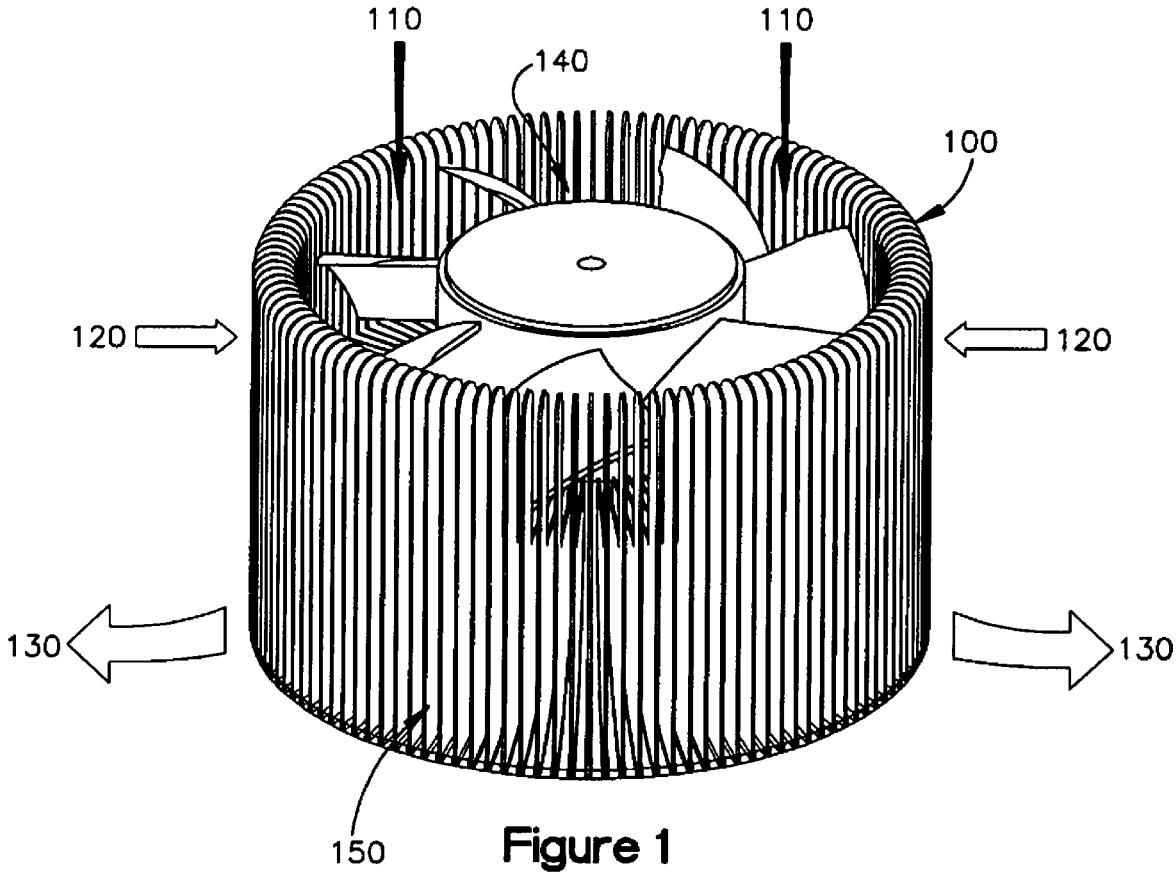
FIG. 1 illustrates an example radial fin heat sink device configured to experience a fan-assisted dual air flow.

FIG. 1 illustrates a heat sink device 100. Heat sink device 100 may be configured to experience a fan-assisted air flow like a dual air flow. Heat sink device 100 may be, for example, a two pass, radial fin heat sink. A housing for fan 140 may be constructed from a base and a set of fins 150. Air may enter the housing through the housing wall (e.g., between fins 150) as well as through an open top of the housing. Air being exhausted from heat sink device 100 passes over the fins 150 a second time as it exits heat sink device 100. Thus a dual air flow may be produced in heat sink device 100.

A first flow 110-130 is produced by fan 140 drawing air into the heat sink device 100 and expelling the air at 130. While two locations 110 and two locations 130 are illustrated, it is to be appreciated that locations 110 generally refer to the open top of device 100 and locations 130 generally refer to openings between fins 150. As the air is expelled at 130, it passes through channels between fins 150. Thus, heat conducted from a heat source into the fins 150 may be dissipated by convection into air flow 110-130. A second flow 120-130 is produced as a result of flow 110-130 in the heat sink device 100. Again, while two locations 120 are illustrated, it is to be appreciated that locations 120 generally refer to openings between fins 150. Flow 110-130 may produce a Bernoulli effect whereby a relatively lower pressure area is produced inside heat sink device 100. Thus, flow 120-130 may result as air from the relatively higher pressure area outside heat sink device 100 is drawn into the relatively lower pressure area inside the heat sink device 100. Air in flow 120-130 also passes through channels between fins 150, which facilitates additional convective cooling and thus producing the second air flow in a dual air flow heat sink.

Conventionally, heat sink device 100 may have been machined from a solid piece of a suitable thermally conductive and machinable material. For example, an extruded bar of aluminum may have been machined using a lathe, a circular slitting saw, and the like. When the fins and base of a heat sink are manufactured from this single solid piece of material, the shape of a fin may be limited to, for example, a substantially flat shape as determined by the device cutting the channel. Thus, various properties (e.g., volume, direction) of the air flows 110-130 and 120-130 may be determined and/or limited by the shape of the fins. Unlike conventional devices, example fins and bases described herein may be fabricated separately, which provides for greater flexibility in fin design. Thus, example fins described herein may be manufactured with an integral stator blade that facilitates controlling air flow properties. For example, configuring a fin 150 with an integral stator blade may facilitate fan 140 pushing air between fins 150 with greater efficiency than in systems where fins 150 do not include an integral stator blade. The stator blade may be, for example, a stationary blade formed integrally into a fin.

Figure 2:
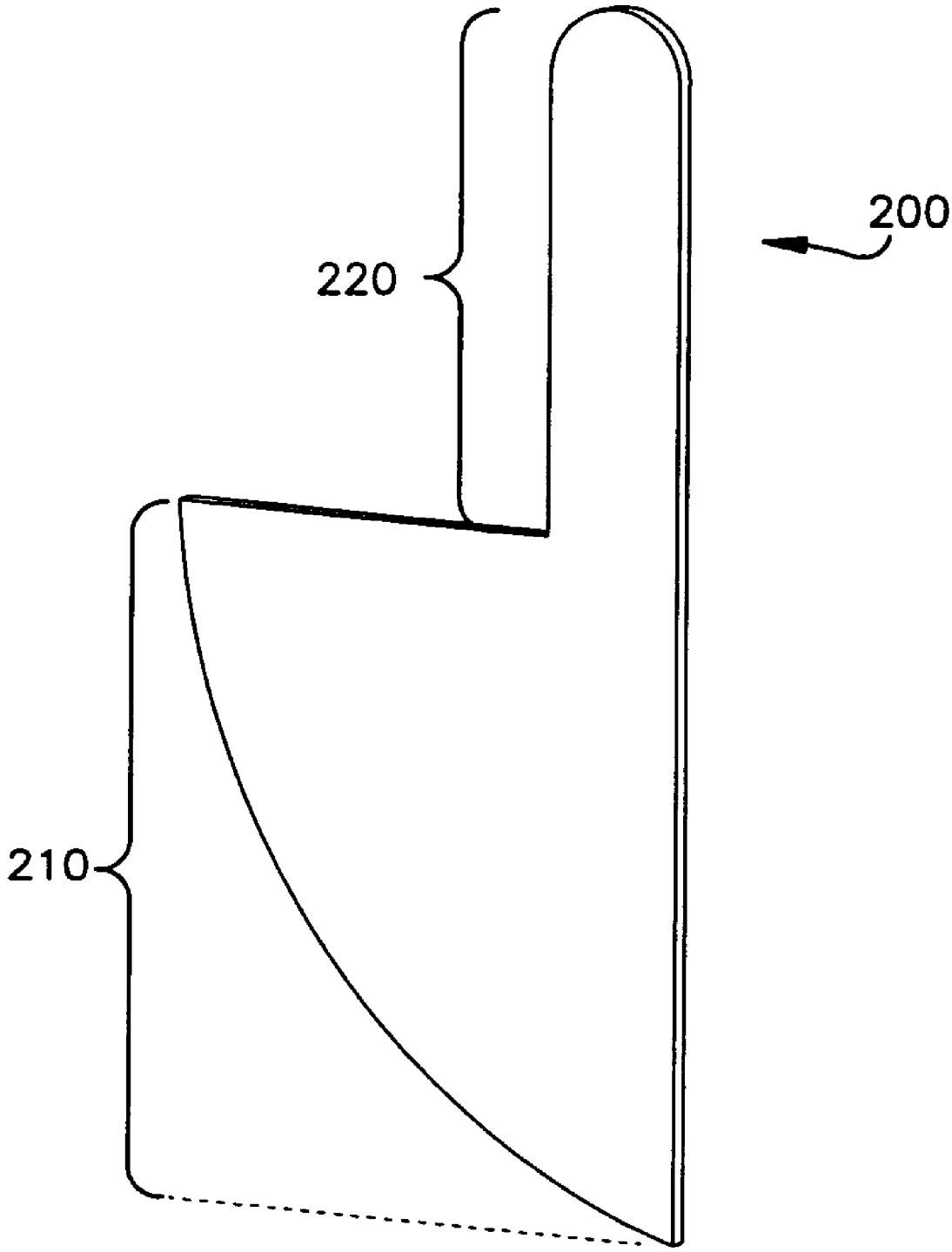
FIG. 2 illustrates an example substantially featureless fin configured for use in a radial fin heat sink device.

FIG. 2 illustrates an example fin 200 that does not include an integral stator blade. Fin 200 is illustrated as being substantially flat with a substantially uniform surface. Fin 200 may be described as having a lower portion 210 an upper portion 220. Fin 200 may be positioned so that blades of a fan (e.g., fan 140, FIG. 1) being used to produce an air flow in a heat sink (e.g., device 100, FIG. 1) will pass above portion 210 as the blades rotate in a housing formed from fin 200 and a base. The air flow may draw air into the heat sink past the upper portion 220 of fin 200. Additionally, the air flow may push air out of the heat sink past the lower portion 210 of fin 200. Various properties (e.g., volume, direction) of these air flows may be affected by the shape of fin 200. Thus, fin 300 (FIG. 3) illustrates a fin 300 that includes an integral stator blade 330.

Fin 300 may be manufactured independently from a base to which it may be attached later. Thus, fin 300 may be configured with a feature like stator blade 330. Additionally, fin 300 may be manufactured from a different thermally conductive material than a base to which it may be attached. In one example, fin 300 may be employed in a radial fin heat sink device configured to experience a fan-assisted dual air flow.

Fin 300 may include, for example, a lower portion 310, an upper portion 320, and an integral stator blade 330. Fin 300 may be positioned so that blades of a fan being used to produce an air flow in a heat sink will pass above portion 310 and stator blade 330 as the fan blades rotate in a housing formed from fin 300 and a base. Stator blade 330 facilitates directing an air flow produced by a fan blade in a desired direction. Additionally, stator blade 330 may facilitate increasing the surface area of fin 300 and thus facilitate dissipating heat from fin 300.

Figure 3A:
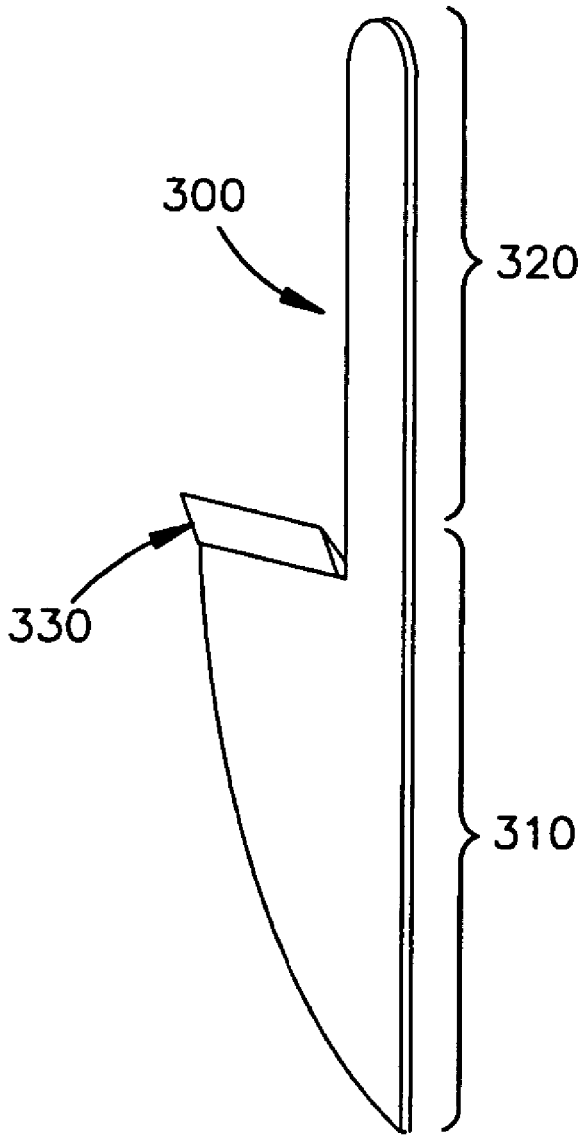
FIG. 3 illustrates an example fin configured with a stator blade.
Figure 3B:
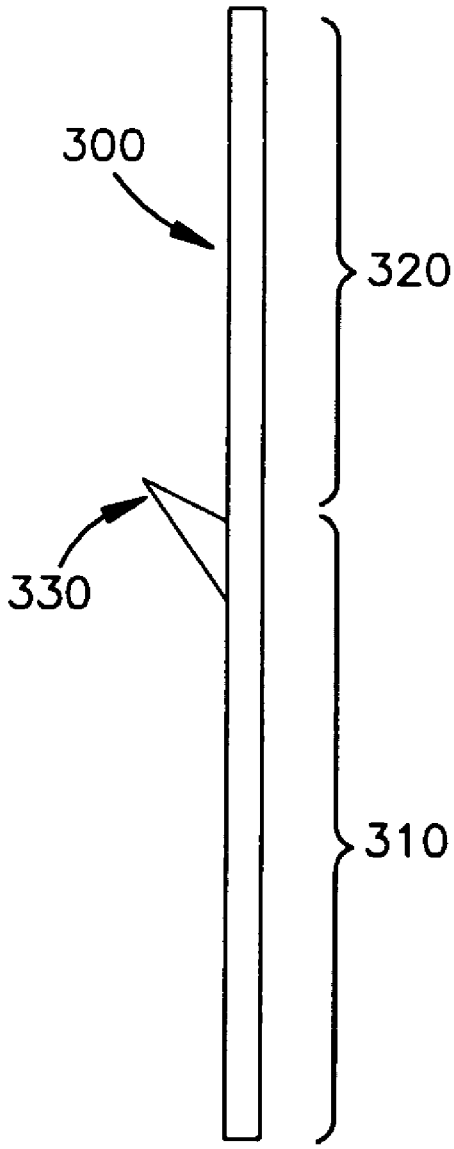

While FIG. 3 illustrates a fin 300 having a first shape and a stator blade 330 having a first size and shape, it is to be appreciated that fins with different shapes and stator blades with different sizes, shapes, and orientations may be produced independently and attached to various bases.

Figure 4:
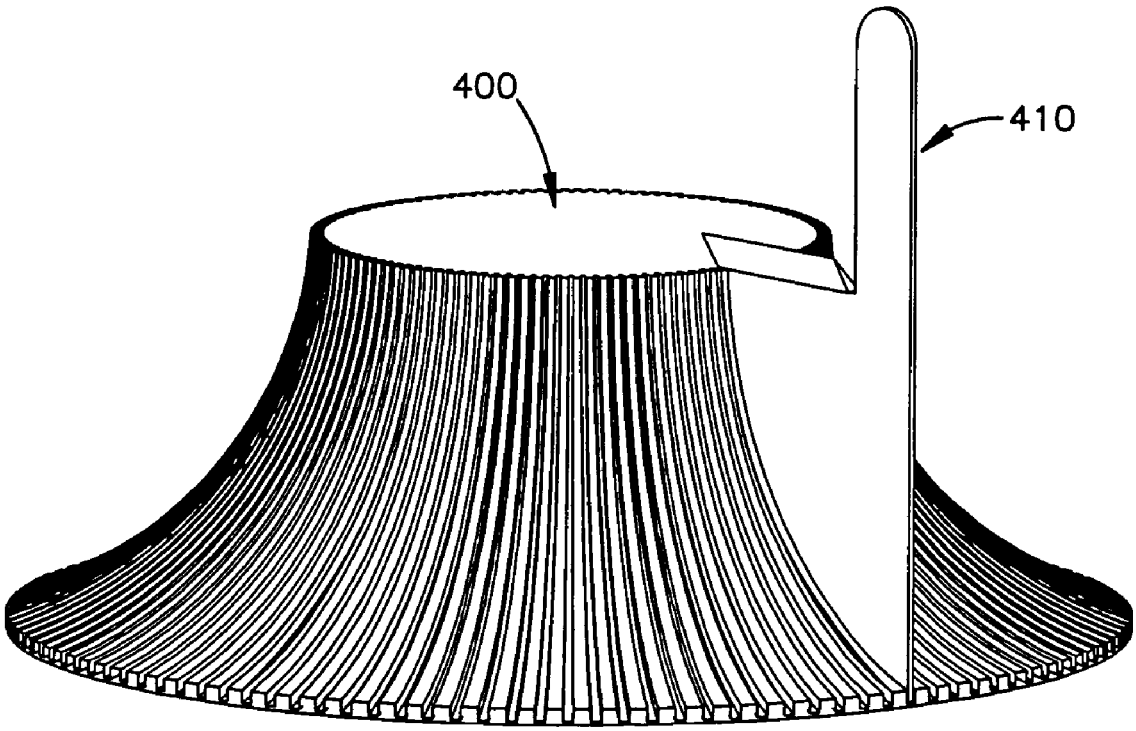
FIG. 4 illustrates an example fin configured with a stator blade, where the fin is attached to a base for a heat sink device.

FIG. 4 illustrates an example base 400 to which a fin 410 having an integral stator blade has been attached. Base 400 may be manufactured separately from fin 410 and may be, for example, a hyperboloid shape. The base 400 and fin 410 may be employed, for example, in a heat sink device configured to experience a fan-assisted dual air flow. Fin 410 may be attached to base 400 using methods including, but not limited to, welding, soldering, male/female attachments, and so on. While fin 410 is illustrated being attached to base 400, it is to be appreciated that fin 410 could be attached to other bases having other shapes and being manufactured from other thermally conductive materials. Over time, heat dissipation requirements for a heat source may change, a fin may become damaged, and so on. Thus, in one example, fin 410 and/or other fins attached to base 400 may be removed and replaced with other fins. Additionally, over time, a fan associated with a heat sink device may wear out or need to be replaced. A replacement fan may have fan blades with different properties (e.g., size, shape, orientation). Thus, in one example, fin 410 may be replaced with a different fin configured with a stator blade with different properties (e.g., size, shape, orientation).

Figure 5:
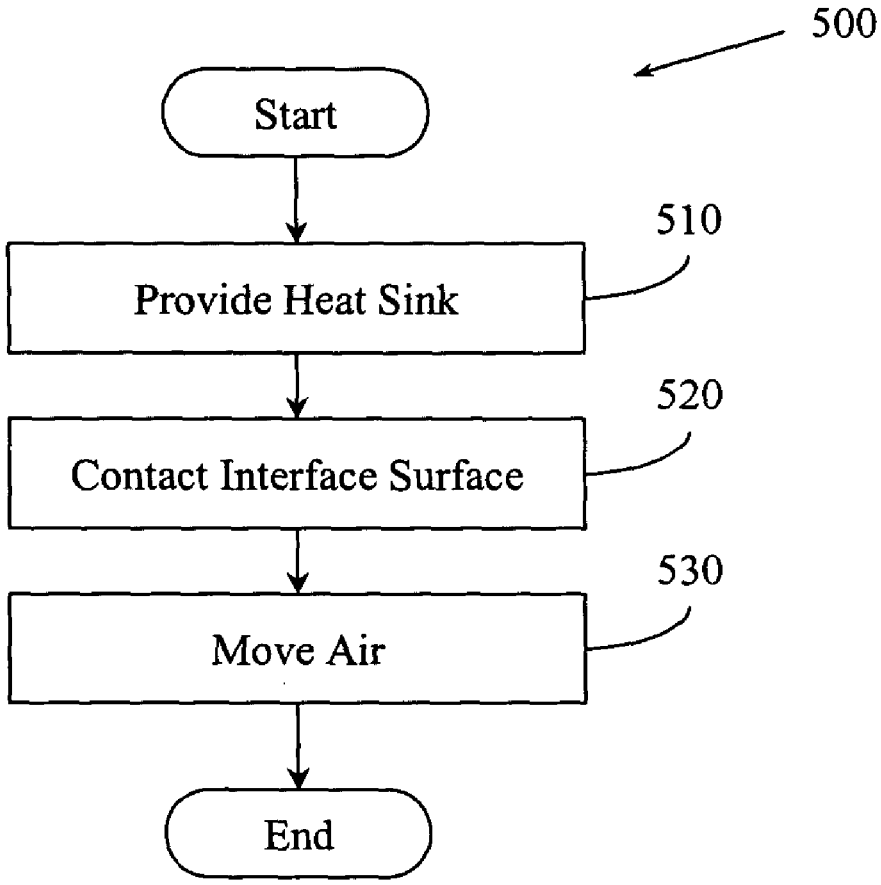
FIG. 5 illustrates an example method for dissipating heat from a heat source by using a heat sink device configured with fins having integral stator blades.
Figure 12:
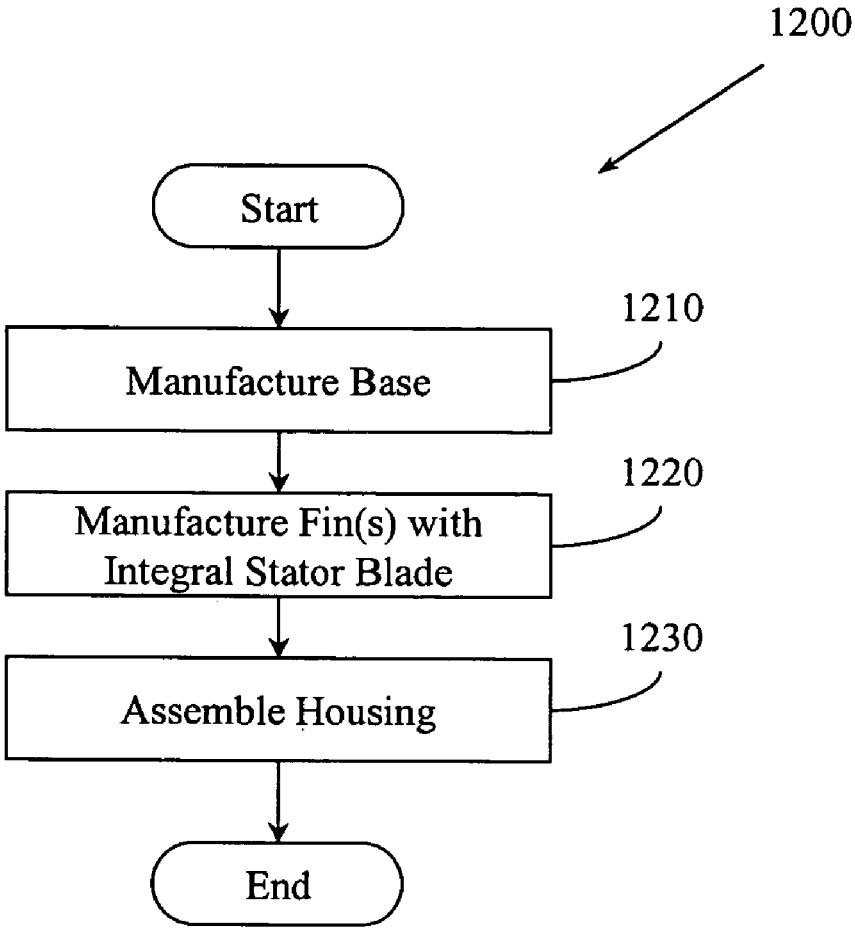
FIG. 12 illustrates an example method for making a heat sink device configured with a fin having an integral stator blade.

Example methods may be better appreciated with reference to the flow diagrams of FIG. 5 and FIG. 12. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Furthermore, additional and/or alternative methodologies can employ additional, not illustrated blocks.

FIG. 5 illustrates an example method 500 for removing heat from a heat source using a heat sink device configured to experience a fan-assisted air flow, where the heat sink device includes a fin configured with a stator blade. Method 500 may include, at 510, providing a heat sink device having a fan-assisted air flow (e.g., dual air flow). The heat sink device may include, for example, a fan and a heat sink that houses the fan. The heat sink may have a base with an interface surface that is configured to contact the heat source. The base may be formed from a first thermally conductive material like copper, aluminum, and so on. The heat sink may also include fins that are manufactured separately from the base and attached to the base. The fins may be configured with a stator blade. The fins may be formed from a second thermally conductive material like copper, aluminum, and so on, and in one example may be removably attachable to the base. It will be appreciated that the first and/or second thermally conductive materials can also include graphite, carbon, gold, silver, combinations of conductive materials, and/or compositions based on conductive materials like graphite/carbon fibers and others. The fins and base may be formed from the same or different thermally conductive materials.

Method 500 may also include, at 520, contacting the interface surface with the heat source, and, at 530, causing the fan to move air in the area of the heat sink and the fins configured with stator blades. An air flow(s) produced by the fan in the heat sink device will be controlled, at least in part, by properties like the size, shape, and orientation of the stator blades with respect to the fan blades.

Figure 6:
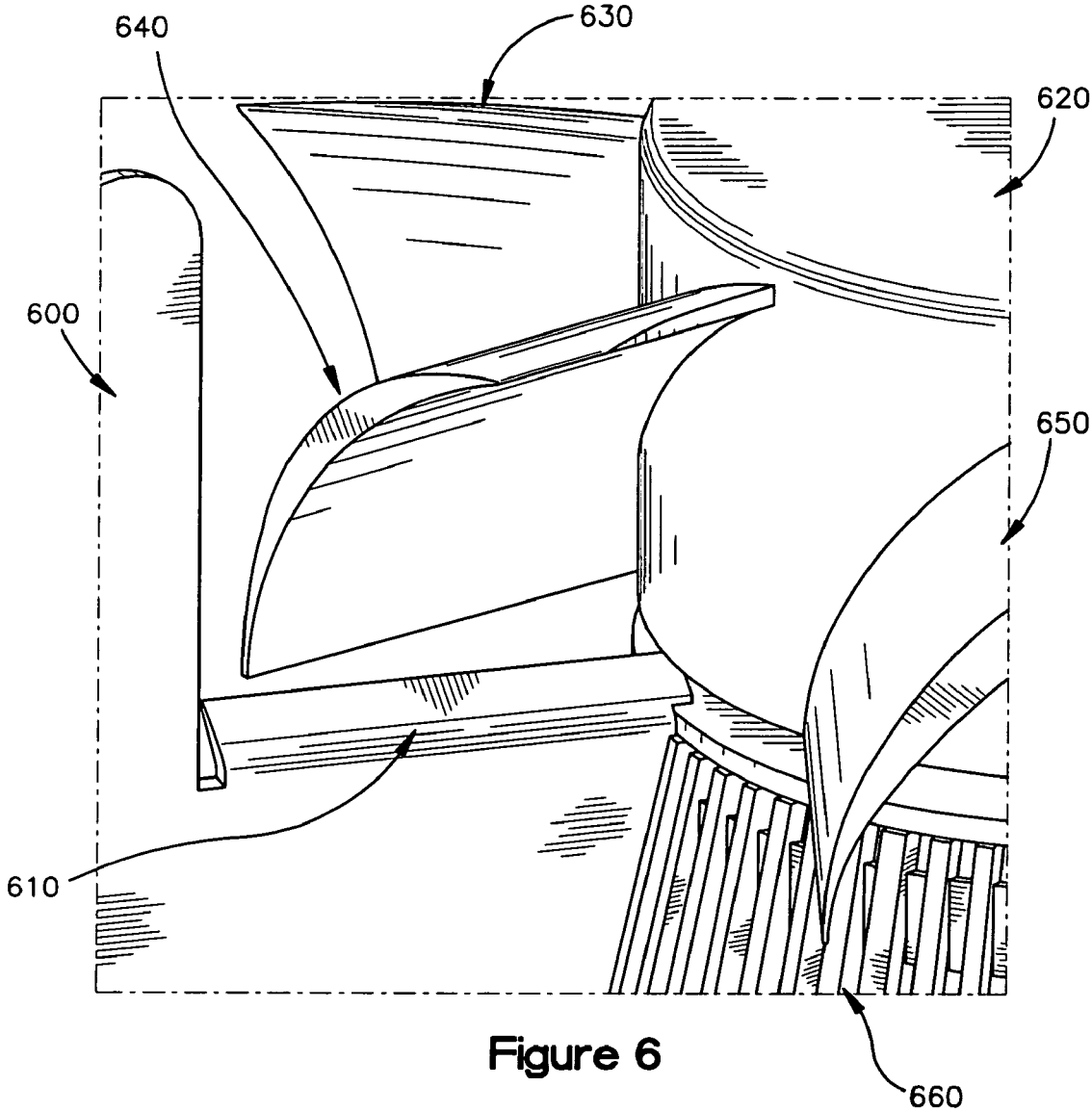
FIG. 6 illustrates an example fin configured with a stator blade interacting with a fan blade in a heat sink.
Figure 7:
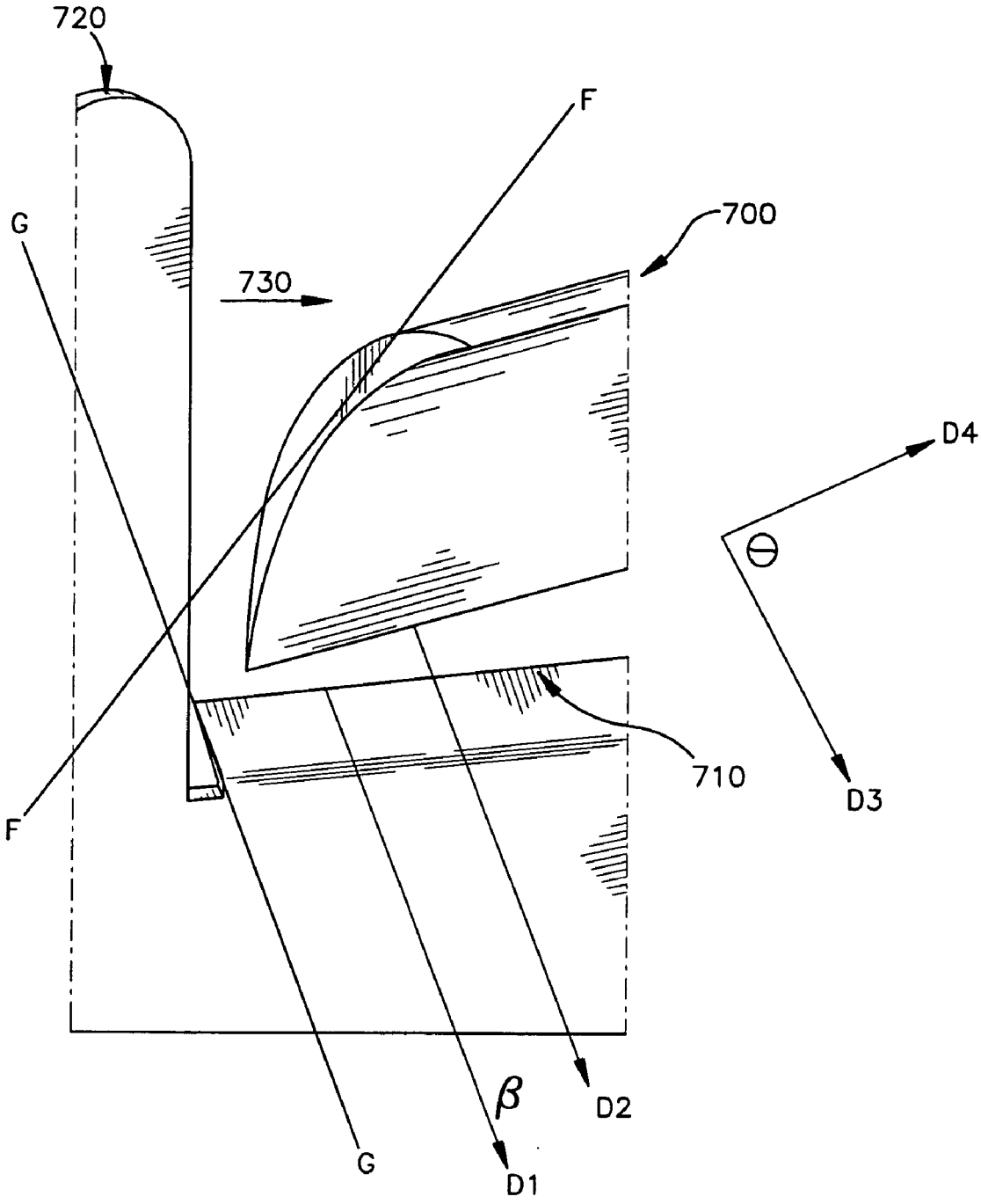
FIG. 7 illustrates another view of an example fin configured with a stator blade interacting with a fan blade.

FIG. 6 illustrates an example fin 600 configured with a stator blade 610. Fin 600 is illustrated as part of an assembly that includes a fan 620 configured with a number of fan blades 630, 640, and 650. Fan 620 may be rotating in a counter clockwise direction above base 660 to which fin 600 is attached. Thus fan blade 650 may have just passed over stator blade 610, fan blade 640 may be partially over stator blade 610, and fan blade 630 may be approaching stator blade 610. As fan 620 rotates, and thus as fan blades 630, 640, and 650 rotate, an air flow is created by the action of the fan blades 630, 640, and 650. Stator blade 610 may be configured, for example, to direct an air flow produced by the fan blades as they rotate and pass over stator blade 610. FIG. 7 facilitates understanding example relationships between a fan blade, an air flow produced by the fan blade, and a stator blade over which the fan blade passes.

FIG. 7 illustrates an example fan blade 700 and a stator blade 710 integral to fin 720. Fan blade 700 has an orientation axis FF that is inclined at an angle with respect to a longitudinal axis of a fan (e.g., fan 620, FIG. 6) to which fan blade 700 may be attached. As the fan rotates in a counter-clockwise direction, fan blade 700 moves generally in the direction indicated by arrow 730. Due to the inclination of fan blade 700, this movement in the direction indicated by arrow 730 results in an air flow in a direction indicated by arrow D2. The direction indicated by arrow D2 is substantially perpendicular to the blade orientation axis FF. Similarly, the direction indicated by arrow D4 is substantially parallel to the blade orientation axis FF.

Stator blade 710 has an orientation axis GG. Arrow D1 is illustrated being parallel to orientation axis GG. Arrow D3 is also illustrated being parallel to orientation axis GG. In one example, axis GG is substantially perpendicular to axis FF and thus substantially parallel to the direction indicated by arrow D2. Thus arrows D1 and D2 are substantially parallel and therefore, an angle $\beta$ between arrows D1 and D2 is substantially zero. Thus, arrow D3 is substantially perpendicular to arrow D4 and an angle $\theta$ between arrows D3 and D4 is substantially ninety degrees.

In one example, stator blade 710 is oriented at an angle with respect to fan blade 700 that makes arrows D1 and D2 exactly parallel and thus angle $\beta$ is exactly zero and angle $\theta$ is exactly ninety degrees. In another example, stator blade 710 may be oriented at an angle with respect to fan blade 700 that makes arrows D1 and D2 be within ten degrees of parallel and thus angle β may have a magnitude of up to ten degrees and angle θ may take values from eighty degrees to one hundred degrees. It will be appreciated that the stator blade 710 can be at a selected angle that is determined to be optimum. The angle can be determined, for example, using analytical and/or empirical methods.

The orientation of stator blade 710 with respect to fan blade 700 may be chosen to affect air flow properties like direction and so on. Controlling the direction of an air flow may influence, for example, the ability to interact with a pressure drop inside an assembly configured to experience a fan-assisted air flow.

Figure 8:
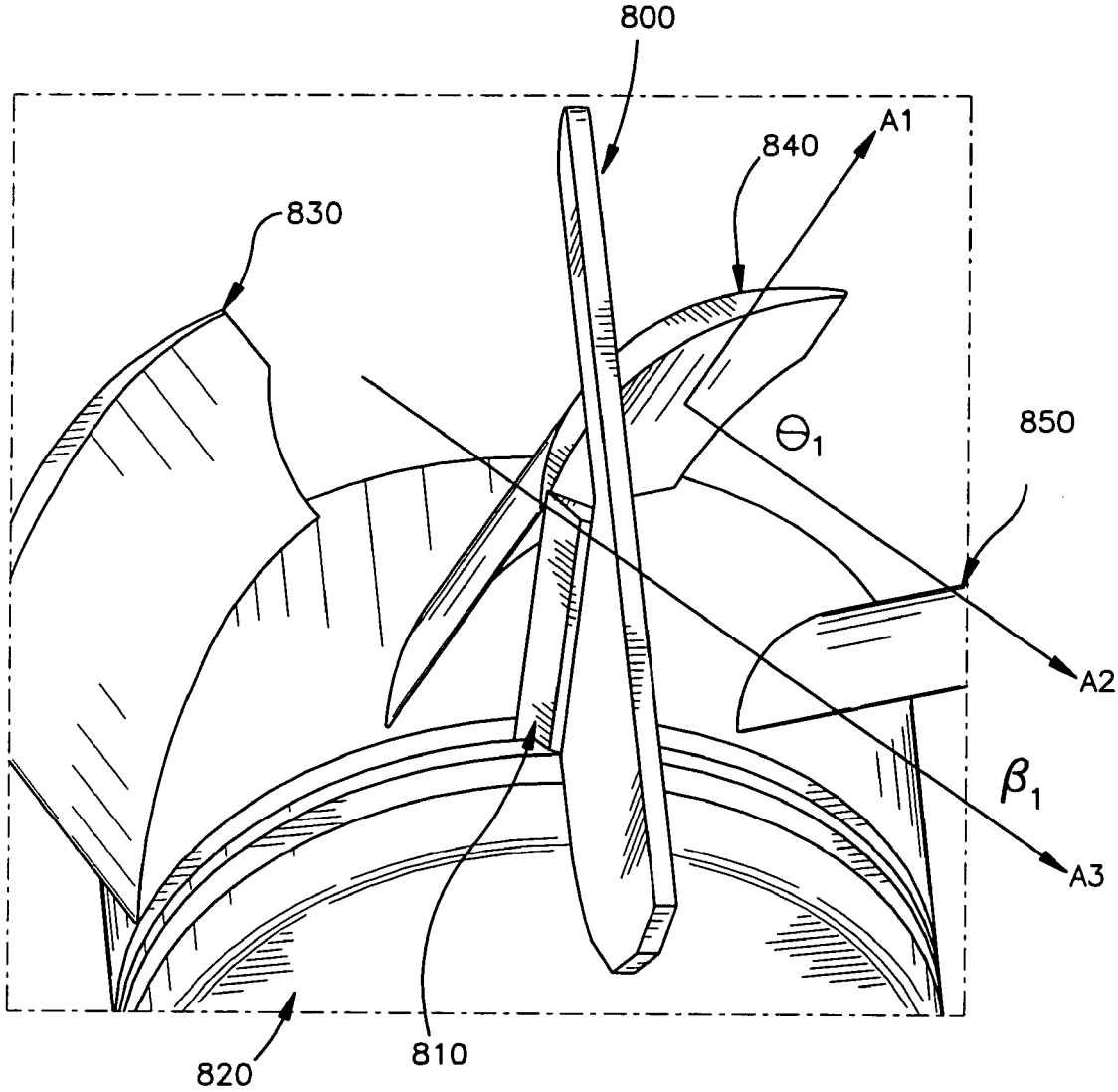
FIG. 8 illustrates an example fin configured with a stator blade interacting with a fan blade in a heat sink.

FIG. 8 illustrates an example fin 800 configured with a stator blade 810. Fin 800 is illustrated as part of an assembly that includes a fan 820 configured with a number of fan blades 830, 840, and 850. Fan 820 may be rotating in a counter clockwise direction and thus fan blade 850 may have just passed over stator blade 810, fan blade 840 may be over stator blade 810 and fan blade 830 may be approaching stator blade 810. As fan 820 rotates, and thus as fan blades 830, 840, and 850 rotate, an air flow is created by the action of the fan blades 830, 840, and 850. Stator blade 810 may be configured, for example, to direct an air flow produced by fan blades (e.g., 830, 840, 850 and others, not illustrated) as they rotate and pass over stator blade 810. For example fan blade 840 may have an orientation axis parallel to the direction indicated by arrow A1. Thus, fan blade 840 may produce an air flow in the direction indicated by arrow A2. Stator blade 810 may have an orientation axis parallel to the direction indicated by arrow A3. In one example, stator blade 810 may be oriented substantially parallel to the direction of the air flow produced by fan blade 840. Thus, arrows A3 and A2 may be substantially parallel and thus arrows A1 and A3 may be substantially perpendicular. Therefore an angle $\theta_1$ that describes a relationship between the orientation of stator blade 810 and fan blade 840 may be substantially ninety degrees. Similarly, an angle $\beta_1$ that describes a relationship between the orientation of stator blade 810 and the air flow produced by fan blade 840 may be substantially zero. While a substantially perpendicular relationship between stator blade 810 and fan blade 840 is described, it is to be appreciated that other relationships may be employed.

Figure 9:
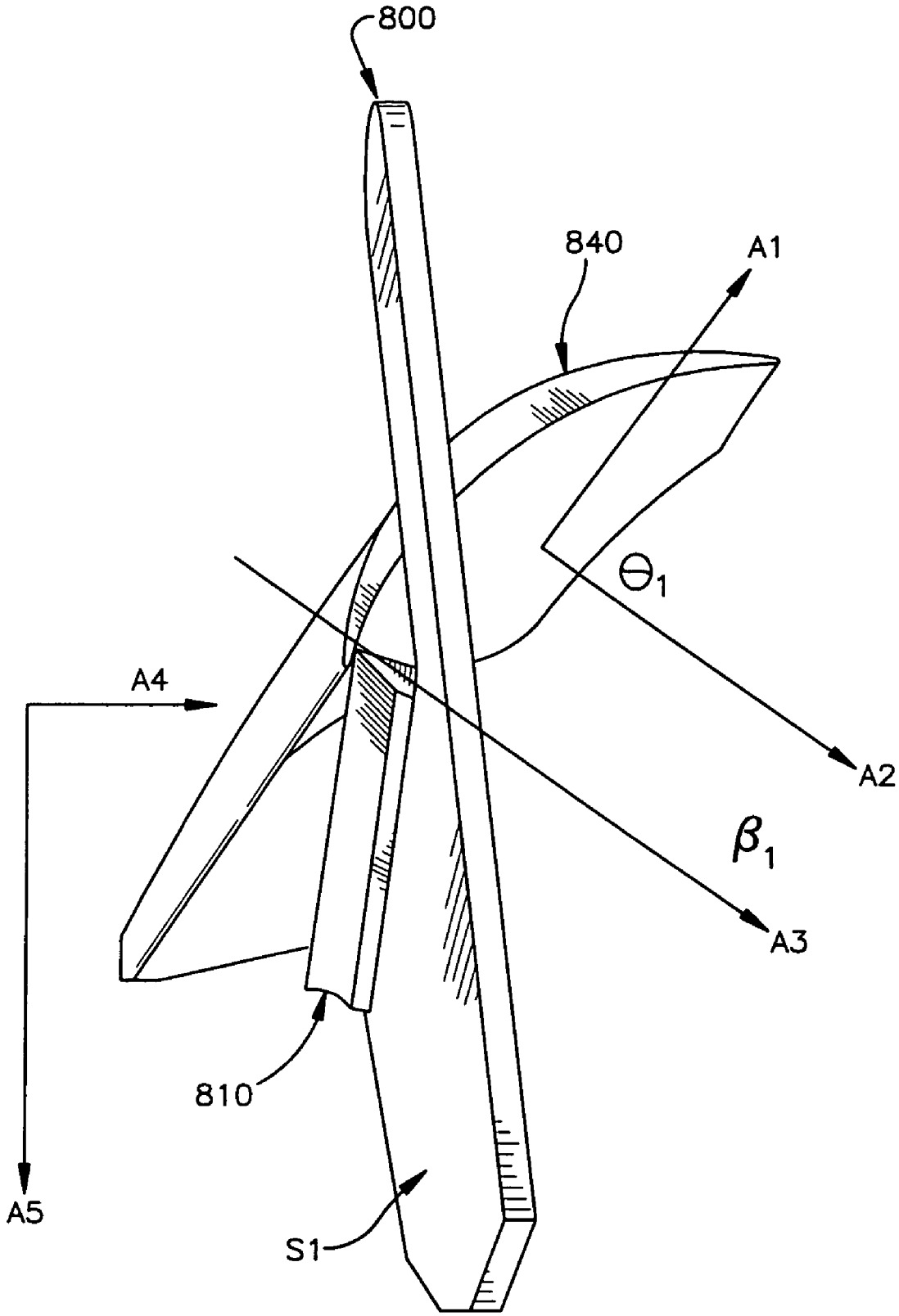
FIG. 9 illustrates another view of an example fin configured with a stator blade interacting with a fan blade.

FIG. 9 facilitates further understanding example relationships between fan blade 840, an air flow produced by fan blade 840, and stator blade 810. As fan blade 840 moves generally in a direction indicated by arrow A4, an air flow generally in the direction indicated by arrow A2 may be produced. It may be desired to control a portion of the air flow produced by fan 840 to flow along surface S1 of fin 800 in the direction indicated by arrow A5. Thus, stator blade 810 may be oriented at an angle $\theta_1$ to fan blade 840. In one example, $\theta_1$ is exactly ninety degrees. In another example, $\theta_1$ may be approximately ninety degrees. In yet another example, $\theta_1$ may be an angle between eighty degrees and one hundred degrees. While stator blade 810 is illustrated having a certain shape, size, and orientation, it is to be appreciated that fin 800 may be configured with other stator blades having other shapes, sizes, and orientations to facilitate an air flow produced by fan blade 840 to have a desired property (e.g., direction).

Figure 10:
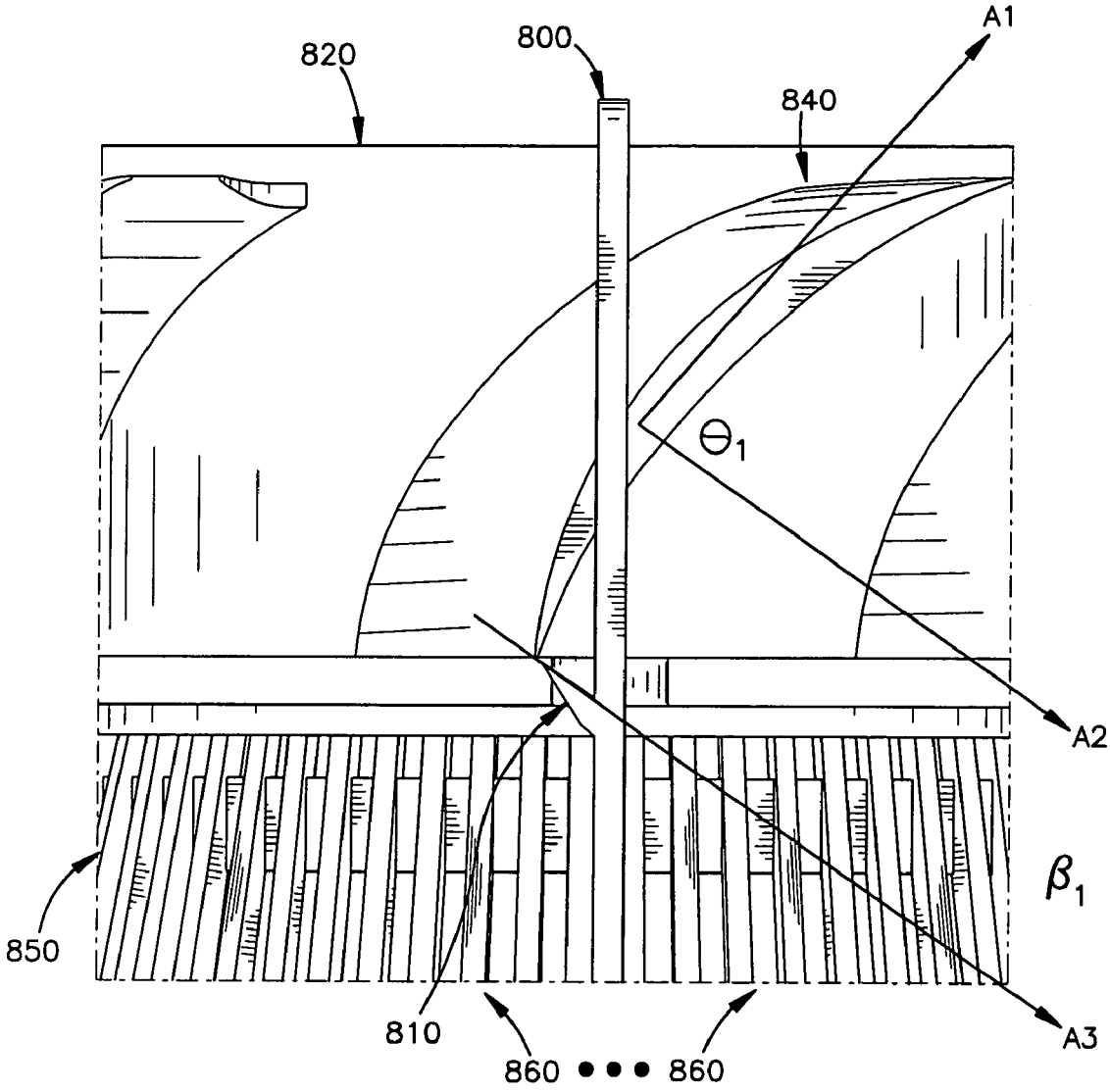
FIG. 10 illustrates an example fin configured with a stator blade interacting with a fan blade in a heat sink configured to experience a fan-assisted dual air-flow.
Figure 11:
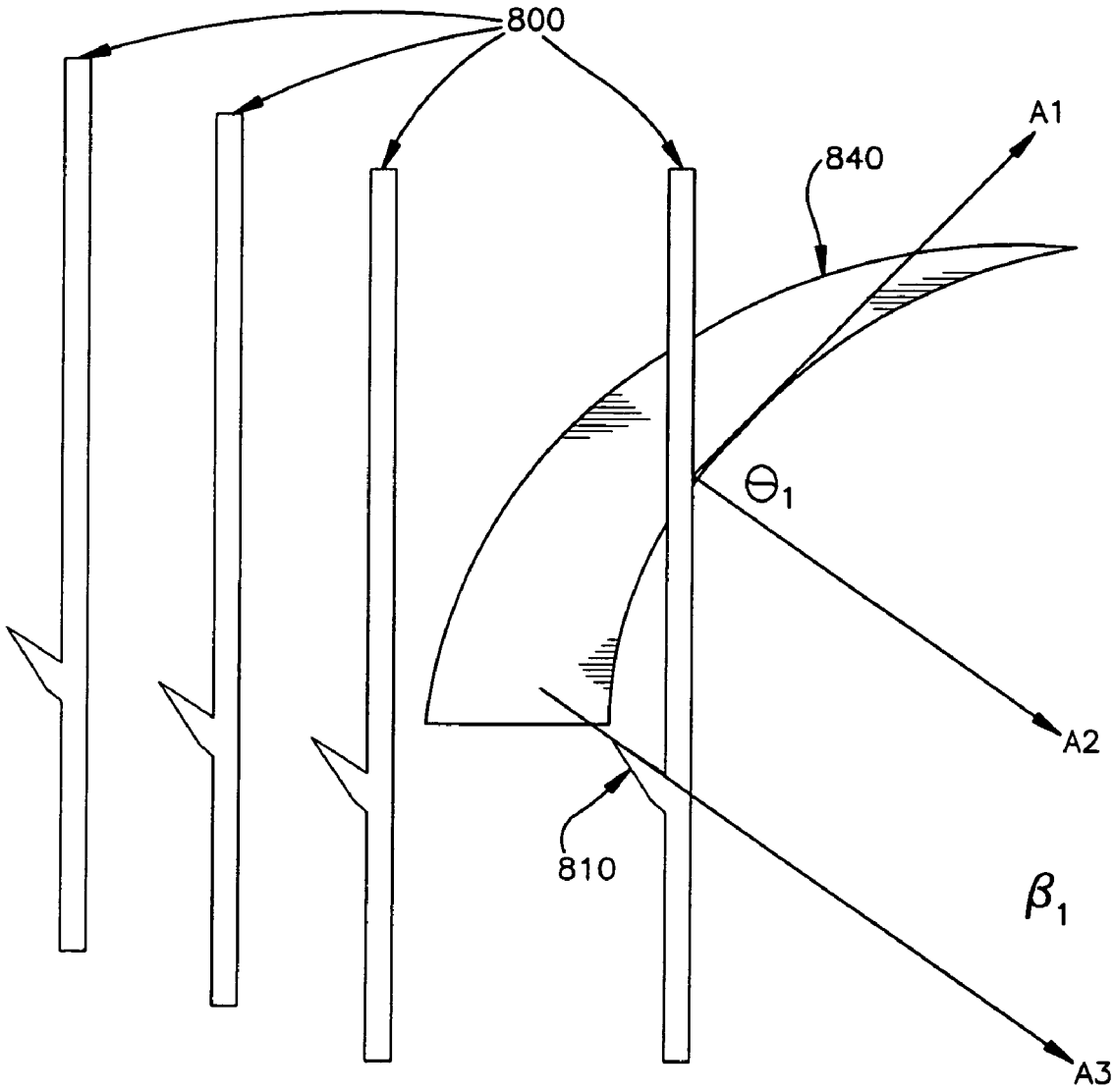
FIG. 11 illustrates another view of an example fin configured with a stator blade interacting with a fan blade.

FIG. 10 illustrates another view of fin 800, stator blade 810, and fan blade 840. While a single fin 800 and stator blade 810 are illustrated, it is to be appreciated that there may be more than one fin 800 attached to base 850. By way of illustration, each location 860 may have a fin attached thereto, every other location 860 may have a fin attached thereto, and so on. Thus, FIG. 11 illustrates yet another view of fins 800, stator blades 810, and a fan blade 840. It is to be appreciated that fins 800 may be attached to a base to form a housing for a fan to which fan blade 840 may be attached.

FIG. 12 illustrates an example method 1200 for making a heat sink device configured with a fin(s) having an integral stator blade. At 1210, a base may be manufactured using techniques including, but not limited to, milling, lathing, machining, forging, and so on. The base may be, for example, hyperboloid in shape. The base may be manufactured, for example, from materials like copper, aluminum, and the like. The base may be manufactured to facilitate attaching a fin(s) configured with an integral stator blade. The base may be manufactured to facilitate producing a fan-assisted dual air flow over a heat sink assembled from the base.

At 1220, a fin may be manufactured using techniques including, but not limited to, milling, pressing, forging, machining, and the like. The fin may have, for example, an integral stator blade. The fin may be manufactured, for example, from materials like copper, aluminum, and the like. It is to be appreciated that the fin may be manufactured from the same material as the base or from a material different from the base. While a single fin is described, it is to be appreciated that a heat sink device may be configured with a number of fins and thus a number of fins may be manufactured. It is to be appreciated that in various examples, the actions performed at 1210 and 1220 may be performed in different locations, at different times, in different orders, and/or substantially in parallel.

At 1230, the base and the fin(s) may be assembled into a housing. FIG. 4 illustrates an example base 400 having been assembled together with a single fin 410. It is to be appreciated that multiple fins may be assembled together with base 400 to form a housing. The housing may be configured, for example, to house a fan. Thus, in one example, method 1200 may also include (not illustrated), placing a fan into the housing formed from the base and the fin(s). In one example, the fan may be configured to produce a fan-assisted dual flow through the housing formed from the base and the fin(s). The base and the fin(s) may be assembled together using techniques including, but not limited to, welding, soldering, mechanical (e.g., bolting) techniques, male/female attachments, and so on.

While example systems, methods, and so on, have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

What is claimed is:

1. A heat sink apparatus configured to house a fan that is configured to produce an air flow in the heat sink apparatus, the heat sink apparatus comprising:

a base comprising a top surface and a side surface extending around the base, the side surface including a plurality of slots;

a fan positioned on the top surface, the fan including fan blades; and a plurality of fins individually attached to the side surface of the base in the plurality of slots, each of the fins including:

a first portion connected to a slot from the plurality of slots and extending out from the side surface;

a second portion extending out from the first portion and parallel to an axis of the fan, wherein the second portions from the plurality of fins encircle the fan; and a stator blade extending out from the first portion in a direction toward the fan, wherein the first portion includes an edge substantially perpendicular relative to the axis of the fan and the second portion has a surface substantially parallel to the axis of the fan, wherein the surface of the second portion is substantially perpendicular to the edge of the first portion and, wherein the edge is between the first portion and the second portion of the fin and the stator blade extends from the edge.

2. The heat sink apparatus of claim 1, where the fan is configured to produce an air flow in the heat sink apparatus.

3. The heat sink apparatus of claim 1, the stator blade of one or more of the plurality of fins being oriented perpendicular to at least one of the fan blades.

4. The heat sink apparatus of claim 1, the stator blade of one or more of the plurality of fins being oriented to within ten degrees of perpendicular to at least one of the fan blades.

5. The heat sink apparatus of claim 1, the stator blade of one or more of the plurality of fins being oriented parallel to a direction of an air flow produced by the fan.

6. The heat sink apparatus of claim 1, the stator blade of one or more of the plurality of fins being oriented to within ten degrees of parallel to a direction of an air flow being produced by the fan.

7. The heat sink apparatus of claim 1, the base having a hyperboloid shape.

8. The heat sink apparatus of claim 7, the base being manufactured from at least one of copper, aluminum, graphite, carbon, gold, or silver.

9. The heat sink apparatus of claim 8, the fin being manufactured from at least one of copper, aluminum, graphite, carbon, gold, or silver.

10. The heat sink apparatus of claim 1, where one or more of the plurality of fins are configured to be individually removed and replaced with a different fin.

11. The heat sink apparatus of claim 1, the fin being attached to the base by one or more of soldering or welding.

12. The heat sink apparatus of claim 1, wherein the first and the second portions define an L-shaped cross-sectional profile.

13. The heat sink apparatus of claim 1, wherein the stator blade protrudes from the first portion at a non-perpendicular angle relative to the edge.

14. The heat sink apparatus of claim 1, wherein the stator blade extends transverse to a plane of the first portion.

15. A heat sink, comprising:

a core;

a plurality of fins arranged about the core to define a receiving area of the heat sink adjacent a mounting surface of the core, each of the plurality of fins comprises:

a first portion having a core interface edge to couple the fin to the core and an intermediate edge adjacent the core interface edge that is substantially perpendicular to a longitudinal axis of the core;

a second portion extending from the intermediate edge of the first portion and away from the mounting surface to at least partially define the receiving area of the heat sink;

a stator blade extending from the intermediate edge and toward the receiving area; and a fan disposed on the mounting surface of the core and within the receiving area, wherein the second portion of the fin has a length extending in a direction along the longitudinal axis of the core that is greater than or equal to a height of the fan when the fan is mounted to the mounting surface.

16. A heat sink of claim 15, wherein the core includes an outer surface having a plurality of slots to receive the plurality of fins.

17. A heat sink of claim 16, wherein the core interface edge has a shape complementary to the shape of the outer surface of the core.

18. A heat sink of claim 15, wherein the core interface edge of the fin includes a curved surface to be received by a slot of the core.

19. A heat sink of claim 15, wherein the stator blade is angled relative to the longitudinal axis of the core.

20. A heat sink of claim 15, wherein the second portion of the fin has a width that is smaller than a width of the first portion of the fin to define the edge.

21. A heat sink of claim 15, wherein the intermediate edge is substantially perpendicular to the longitudinal axis of the core.

22. A heat sink of claim 15, wherein the core includes a mounting surface in the receiving area that is substantially perpendicular to the longitudinal axis of the core.

23. A heat sink of claim 22, wherein the intermediate edge is substantially aligned with the mounting surface of the core.

24. A heat sink of claim 15, wherein the second portions of the fins completely surround a perimeter of the fan.

25. A heat sink apparatus of claim 15, wherein the stator blade is oriented substantially perpendicular to a fan blade of the fan.

* * * * *